US011214392B2

(12) United States Patent
Hughes

(10) Patent No.: US 11,214,392 B2
(45) Date of Patent: Jan. 4, 2022

(54) APPARATUS AND PROCESS FOR FORMING A GABLE TOP SEAL

(71) Applicant: EVERGREEN PACKAGING, LLC, Memphis, TN (US)

(72) Inventor: Michael P. Hughes, Cedar Rapids, IA (US)

(73) Assignee: Evergreen Packaging, LLC, Memphis, TN (US)

( * ) Notice: Subject to any disclaimer, the term of this patent is extended or adjusted under 35 U.S.C. 154(b) by 27 days.

(21) Appl. No.: 16/427,004

(22) Filed: May 30, 2019

(65) Prior Publication Data

US 2019/0367197 A1 Dec. 5, 2019

Related U.S. Application Data

(60) Provisional application No. 62/677,700, filed on May 30, 2018.

(51) Int. Cl.

| | |
|---|---|
| ***B65B 7/20*** | (2006.01) |
| ***B65B 43/08*** | (2006.01) |
| ***B65B 43/54*** | (2006.01) |

(52) U.S. Cl.

CPC ..... *B65B 7/20* (2013.01); *B65B 43/08* (2013.01); *B65B 43/54* (2013.01)

(58) Field of Classification Search

CPC .... B65B 7/20; B65B 7/22; B65B 7/24; B65B 7/26; B65B 43/08; B65B 43/54

USPC ..... 53/565

See application file for complete search history.

(56) References Cited

U.S. PATENT DOCUMENTS

| | | | | |
|---|---|---|---|---|
| 4,515,580 | A * | 5/1985 | Lovelace | B65B 43/24 493/183 |
| 5,809,741 | A * | 9/1998 | Tovey | B65B 61/24 53/289 |
| 5,975,158 | A * | 11/1999 | Gordon | B65B 43/54 141/114 |
| 6,430,899 | B1 * | 8/2002 | Cicha | B65B 51/144 53/477 |
| 2016/0297163 | A1 * | 10/2016 | Wieser | B65B 3/025 |
| 2017/0015078 | A1 * | 1/2017 | von Birgelen | B65B 43/24 |
| 2019/0193363 | A1 * | 6/2019 | Wieser | B65B 7/18 |
| 2019/0375531 | A1 * | 12/2019 | Myers | B65B 3/003 |

* cited by examiner

*Primary Examiner* — Anna K Kinsaul
*Assistant Examiner* — Himchan Song
(74) *Attorney, Agent, or Firm* — Vedder Price P.C.

(57) ABSTRACT

A clamp and a process of using a clamp within a gable top carton conveyor system is provided. The clamp and process of using the clamp provides for improved alignment of gable top cartons such that the edges are better aligned and can form a more effective heat seal.

3 Claims, 4 Drawing Sheets

APPARATUS AND PROCESS FOR FORMING A GABLE TOP SEAL

RELATED APPLICATIONS

This application claims the benefit of U.S. Provisional Application Ser. No. 62/677,700 filed on May 30, 2019 and which is incorporated herein by reference.

FIELD OF THE INVENTION

This invention is directed towards an apparatus and process that provides an improved seal for a gable top carton. In gable top carton packaging machines, there is frequently a closed conveyor flight that forms a pocket for receiving a bottom sealed gable top carton. The apparatus and process, provides for an improvement in the squaring of the gable top portion of different sized cartons so that the gable edges are better aligned and can form an effective and more aesthetic looking seal. The apparatus and process also enables an improved gable top seal when utilizing thinner gauge carton stock. Thinner carton stock is more prone to misalignment during the gable top carton seal step.

BACKGROUND OF THE INVENTION

This invention relates to improvements in a packaging machine using welded fixed dimension closed pocket conveyor flights. Such flights having a fixed dimension and are difficult to accommodate various thicknesses and carton heights in order to make an acceptable gable top seal. Gable top cartons of all thicknesses and heights, due to various carton restraints requirements while forming the gable, pose difficulty in handling. The fixed pockets, while having many useful attributes, create situations that do not normally exist in other types of conventional gable top carton equipment. Consumers will frequently reject gable top packaging products that have uneven gable seals or misaligned edges. While such seals are functionally sufficient, consumers will not select sealed cartons having poor aesthetics and margins in the seal area. Such products frequently remains unsold and ends up being waste.

Accordingly, there remains room for improvement and variation within the art.

SUMMARY OF THE INVENTION

It is one aspect of at least one of the present embodiments to provide a carton squaring clamp comprising: a horizontal platform; a first edge wall and a second edge wall extending downwardly from opposite edges of the platform;

a midwall positioned between the pair of the opposing edge walls and extending downwardly from a lower surface of the platform; a first tab member carried by a front surface of the first edge wall; a second tab member carried by a front surface of the second edge wall; a vertical wall carried on an upward surface of the horizontal platform, the vertical wall having a front surface and a rear surface; a left edge of the vertical wall in perpendicular communication with a first side wall, the first side wall further defining a lip which extends beyond the plane of the vertical wall front surface; and, a right edge wall of the vertical wall in perpendicular communication with a second side wall, the second wall in proximity to a mid point of the horizontal platform, a front edge of the second side wall defining, a L-shaped camming surface a portion of which extends beyond the vertical wall front surface plane, the first edge wall and the first side wall being substantially contiguous and defining an arcuate groove there between.

It is a further aspect of at least one of the present embodiments of the invention to provide for a process of forming a gable top carton comprising the steps of; bottom forming a carton blank into a four-sided sleeve; placing the four-sided sleeve within the packaging conveyor flight, the conveyor flight in communication with a clamp engaging one side wall of the carton sleeve, the clamp being further engaged by the spring attached to a bottom portion of the clamp, a spring providing an engaging force between the clamp and the carton sleeve; moving the conveyor flight, carton sleeve, and clamp within a filling and forming machine; selectively engaging a camming portion of the clamp, thereby moving the clamp away from the carton sleeve surface, thereby facilitating vertical movement of the carton sleeve within the conveyor flight; disengaging the camming portion of the clamp, thereby placing the clamp in an engaged position with respect to the carton sleeve, thereby holding the carton sleeve with sufficient tension to prevent vertical movement therein, the securing force further positioning the carton sleeve within the conveyor flight such that the side wall corners of the carton sleeve each form a 90 degree angle, thereby providing an improved carton sleeve orientation when making a gable top seal.

It is a further aspect of at least one embodiment of the invention to provide for a carton flight for a gable top packaging machine in which the carton flight has positioned thereto a spring actuated squaring clamp which is adapted for engaging a paperboard sleeve retained with the carton flight.

It is a further aspect of the one embodiment of the present invention to provide for a gable top carton filling machine wherein the filling machine has a conveyor flight adapted for receiving a bottom sealed carton sleeve; and, a clamp, the clamp spring mounted to an edge wall of the conveyor flight, the clamp defining at least one carton sleeve engaging, surface.

It is a further aspect of at least one embodiment of the present invention to provide for a clamp adapted for use on a gable top packaging and, filling machine in which the clamp defines a camming surface which is adapted to engage a cam member positioned on the filling machine. The filling machine cam and the camming surface of the clamp provides for a mechanism that can disengage the clamp portions in contact with the paperboard sleeve so as to allow the sleeve height to be positioned within the conveyor flight.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Figure 1A:
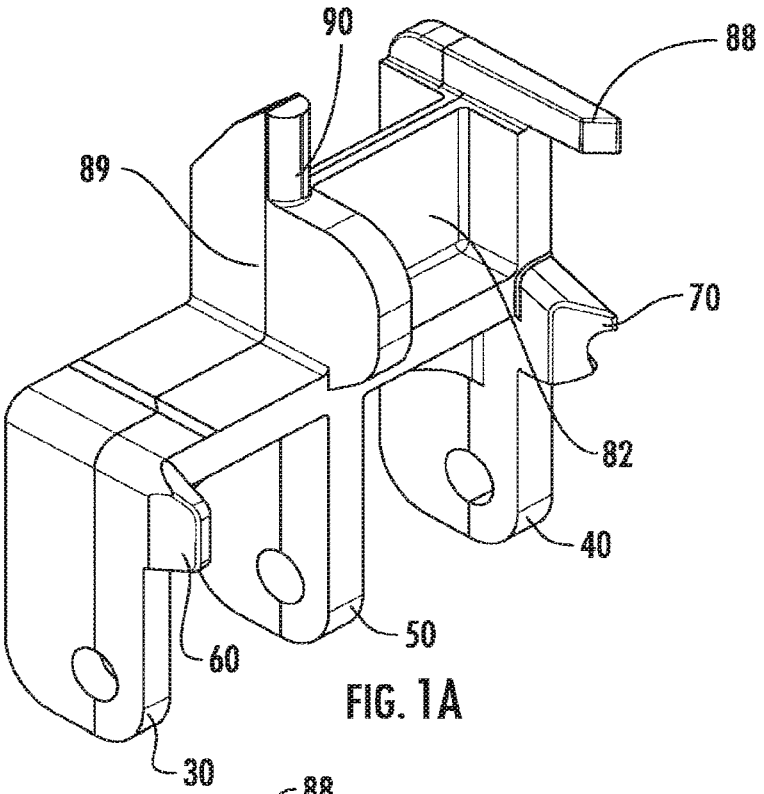
FIG. 1A-1D are perspective views of a clamp according to one embodiment of the present invention.
Figure 1B:
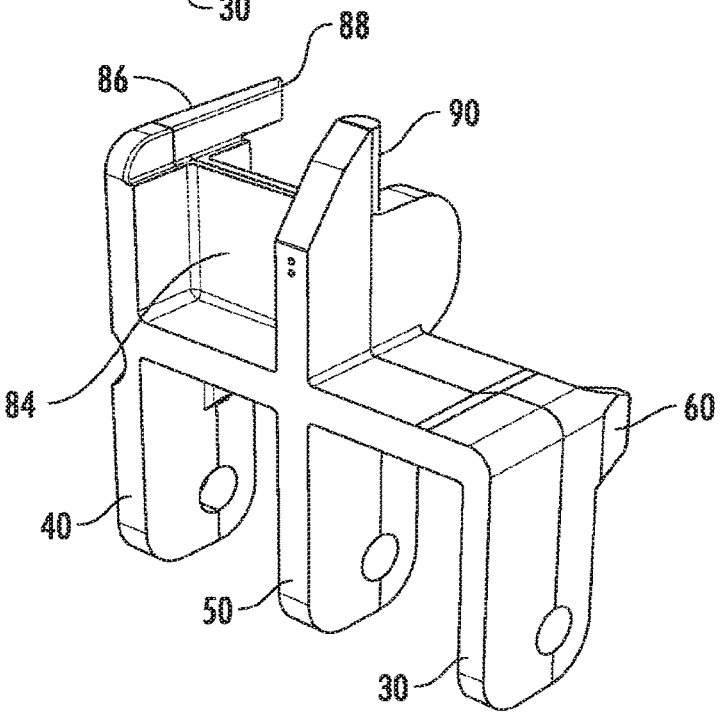
Figure 1C:
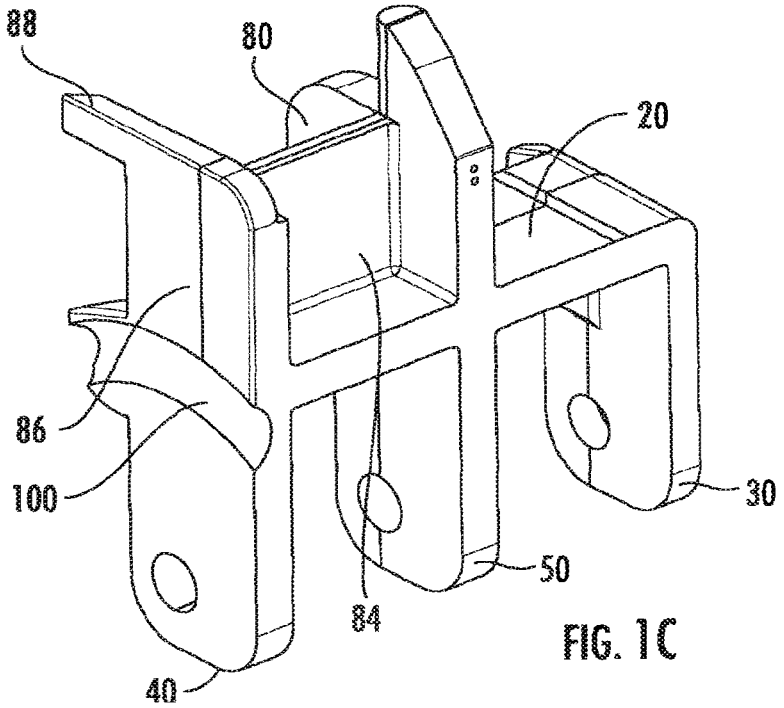
Figure 1D:
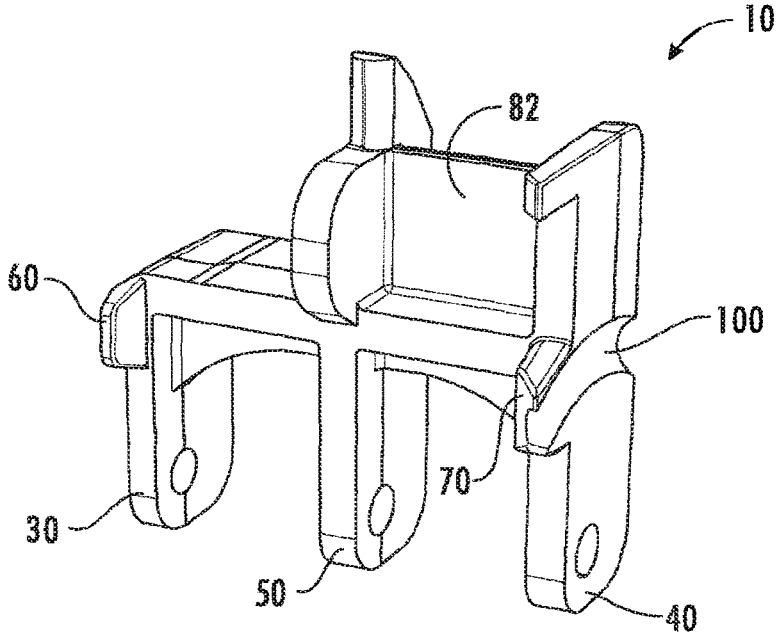

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

As used herein, the term "effective amount" means the state value or range, plus or minus 10%, unless a more specific value or range is provided. Formulations which may be listed or claimed as "comprising of" may also be used as, formulations listed or claimed as "consisting of."

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

As set forth in FIGS. 1A-1D is a squaring clamp in accordance with one embodiment of the invention. The squaring clamp 10 has a horizontal platform 20, a first edge wall 40 and a second edge wall 30 extending downwardly from opposite edges of the platform 20. A midwall 50 is positioned between the pair of opposing edge walls 30 and 40 and extend downwardly from a lower surface of the platform 20. A first tab member 60 is carried by a front surface of the first edge wall and the second tab member 70 is carried by a front surface of the second edge wall. A vertical wall 80 is carried on an upward surface of the horizontal platform 20, the vertical wall having a front surface 82 and a rear surface 84.

A first edge of the vertical wall is in perpendicular communication with a first side wall 86, the first side wall 86 further defining a lip 88 which extends beyond a plane of the vertical wall front surface. A second edge of the vertical wall is in perpendicular communication with a second wall 89, the second wall in proximity to a mid-point of the horizontal platform, a front edge 90 of the second wall defining a L-shaped camming surface 90, a portion of which extends beyond the vertical wall of the front surface plane and the first edge wall and the first side wall 86 being substantially contiguous and defining an arcuate groove 100 there between.

Figure 2:
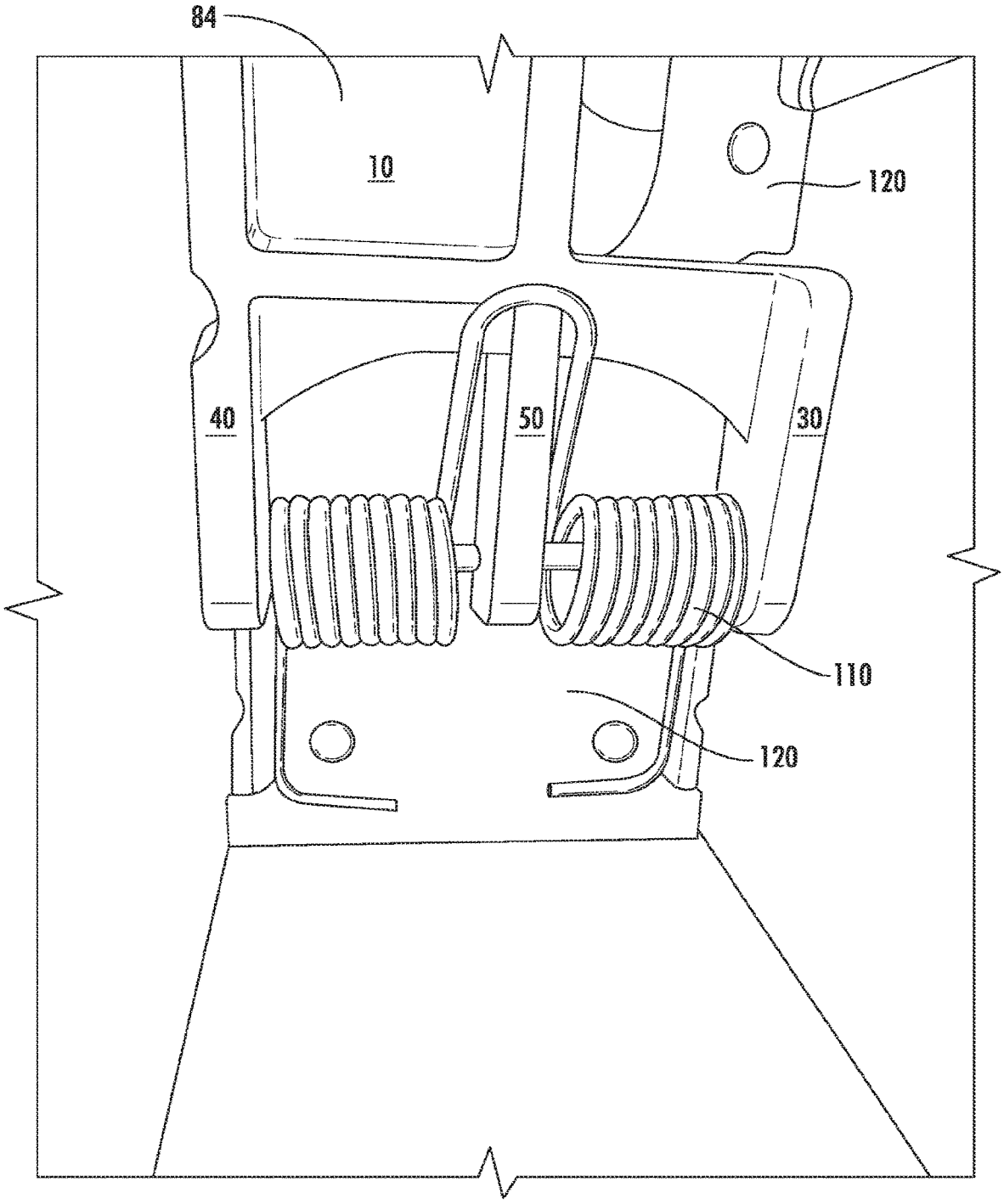
FIG. 2 is a perspective view of a clamp engaged by a spring along a base of the clamp and shown secured within a flight of a package filling and forming machine for gable top cartons.

The edge walls 30 and 40 and the mid-wall 50 each defines an aperture extending through the wall portions and in substantially axial alignment with each of the other apertures. As best seen in reference to FIG. 2, a spring member 110 can be placed and secured in the spaces between the walls 30, 40, and 50 such that a tensioning force is directed against the clamp 10. Clamp 10, seen in FIG. 2, has an orientation similar to FIG. 1B and is positioned within a conveyor flight 120.

When the clamp 10 and spring 110 are operatively engaged with a conveyor flight, the spring operates to maintain an engaged force against the rear of the clamp 10. In doing so, the clamp 10 will engage a bottom sealed carton sleeve carried within the flight and help maintain the carton sleeve such that each of the four corners of the sleeve forms a substantially 90 degree angle. By maintaining the carton sleeve in a 90 degree angled configuration, the carton is kept in a square and true orientation that facilitates forming a more precise and aligned seal between the upper gable portions of the carton blank.

Absent the engaging force provided by the clamp 10, cartons blanks having a tendency to shift within the flight which can create problems with the filling and conveying of the carton blanks. Additionally, absent the securing clamp force, the upper portions of the carton blank sleeve will not form a 90 degree angle and therefore takes on a "diamond" type of orientation. The orientation makes it more difficult to form a desirable seal within the gable portion of the carton.

In accordance with this invention, it has been found that use of the clamp helps provide for a process that will facilitate the use of varying thicknesses of carton board material while still maintaining an ability to form a desirable seal.

For instance, the use of a thinner gauge paperboard material for a gable top carton blank generally is associated with poor squaring characteristics in conventional filling and conveying equipment. Accordingly, the use of thin or lower grade paperboard results in a tendency for the gable seals to be misaligned which is an issue for consumers who associate misaligned edges with a compromised gable top carton.

Figure 3:
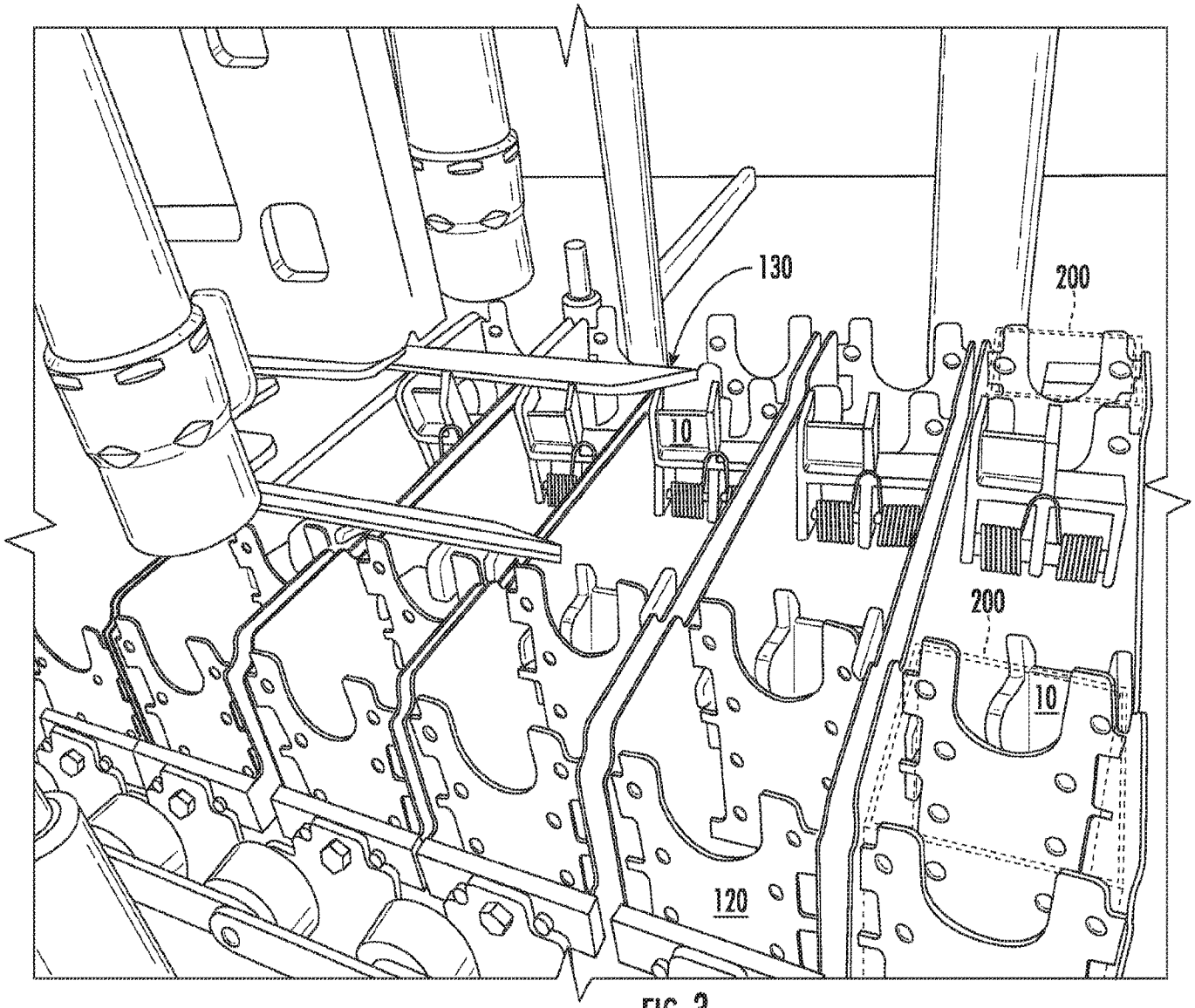
FIG. 3 is a perspective view of a plurality of carton conveyor flights with the squaring clamp positioned relative to the conveyor flight.

An additional advantage of the clamp is that the filling and forming steps of a packaging machine can now selectively engage and disengage the carton sleeve with sufficient force to either prevent or to facilitate vertical movement within the flight as best seen in reference to FIG. 3. For instance, in various packaging stages where the vertical movement of the carton sleeve within the carton flight 120 is desired, the conveying equipment can use a cam member 130, such as an angled edge wall of a metal bar, to engage a cam portion of the clamp such that the clamp is moved away from the carton sleeve and which allows the carton sleeve to be more easily manipulated, with respect to vertical placement and movement within the flight. Similarly, where a engaging force of the carton sleeve is desired, the cam member 130 can be removed or disengaged from the rail and the clamp 10 will provide a securing force to the carton sleeve which provides both a desired 90 degree wall structure to the sleeve as well as providing for a securing force that prevents undesired vertical movement of the sleeve within the flight. To the extent the cam member 130 is physically engaging and disengaging from the clamp as the flight moves through a packaging process, the clamping process does not require any additional delay or timing. In other words, use of the clamping device does not require either a longer conveyor path or any increase in residence time within a particular station of the conveyor and filling the equipment. Accordingly, the clamp and the process of using the clamp provides for an efficient operation of the packaging machinery while achieving, improvements in the filling process and in the formation of the gable seal.

As best seen in reference to FIGS. 1A-1D, portions of the clamp are adapted for engaging a surface of the carton sleeve. For instance, the first tab member 60 provides for a structure that facilitates firmly engaging and holding the carton at a nearest corner against the fixed conveyor pocket opposing wall.

As further seen in the references, the second tab member 70 is designed to engage a surface of the carton sleeve and helps to gradually push forward the carton against the fixed conveyor pocket. As seen in FIG. 3, the outline of a portion of a carton sleeve 200 is seen within the interior of a carton flight 120.

Lip 88 which extends beyond the plane of the vertical wall front surface engages the carton sleeve and is useful in gradually pushing the carton forward, especially shorter size carton blanks, and in communication, with tab 70.

The vertical upright portion of the camming surface 90 is designed to be impinged by a cam member such as a rail or other engaging member which will move the clamp in a disengaged direction from the carton sleeve. As, long as the rail is engaging the cam surface 90, there is no pressure from the clamp applied to the sleeve and, if desired, vertical positioning the sleeve within the flight can occur. Similarly, when the cam surface 90 is disengaged, the spring wilt assert an engaging force such that the respective portions of the clamp engage a surface of the carton sleeve thereby holding the sleeve a fixed position within the conveyor flight and further providing for a "squaring force" such that the sleeve corners each form a 90 degree angle thereby facilitating alignment of the portions of the gable seal area.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged, both in whole, or in part. Therefore, the spirit and scope of the invention should not be limited to the description of the preferred versions contained therein.

The invention claimed is:

1. A carton squaring clamp comprising:

a horizontal platform;

a first edge wall and a second edge wall extending downward from opposite edges of the platform;

a midwall positioned between the pair of the opposing edge walls and extending downward from a lower surface of the platform;

a first tab member carried by a front surface of the first edge wall; the first tab member is configured to engage and firmly hold a carton sleeve at a certain pre-determined location;

a second tab member carried by a front surface of the second edge wall; wherein the second tab member is configured to engage a surface of a carton sleeve and push the carton against a fixed conveyor pocket;

a vertical wall carried on an upward surface of the horizontal platform, the vertical wall having a front surface and a rear surface;

a first side wall in perpendicular communication with a first edge wall of the vertical wall, the first side wall further defining a lip which extends beyond the plane of the vertical wall front surface and configured to engage the carton sleeve;

a second side in perpendicular communication with a second edge wall of the vertical wall, the second wall in proximity to a midpoint of the horizontal platform, a front edge of the second side wall defining an L-shaped camming surface a portion of which extends beyond the vertical wall front surface, plane, the first edge wall and the first side wall being substantially contiguous and defining an arcuate groove there between.

2. The carton squaring clamp of claim 1 wherein the carton squaring clamp is positioned within a carton flight of a gable top packaging machine.

3. A gable top carton filling machine comprising:

a conveyor flight adapted for receiving a bottom sealed carton sleeve;

a carton squaring clamp, the carton squaring clamp spring mounted to an edge wall of the conveyor flight, the carton squaring clamp defining at least one carton sleeve engaging surface;

wherein the clamp comprising:

a horizontal platform;

a first edge wall and a second edge wall extending downward from opposite edges of the platform;

a midwall positioned between the pair of the opposing edge walls and extending downward from a lower surface of the platform;

a first tab member carried by a front surface of the first edge wall; wherein the first tab member is configured to engage and firmly hold a carton sleeve at a certain pre-determined location;

a second tab member carried by a front surface of the second edge wall; wherein the second tab member is configured to engage a surface of a carton sleeve and push the carton against a fixed conveyor pocket;

a vertical wall carried on an upward surface of the horizontal platform, the vertical wall having a front surface and a rear surface;

a first side wall in perpendicular communication with a first edge wall of the vertical wall, the first side wall further defining a lip which extends beyond the plane of the vertical wall front surface and configured to engage the carton sleeve;

a second side wall in perpendicular communication with a second edge wall of the vertical wall, the second wall in proximity to a midpoint of the horizontal platform, a front edge of the second side wall defining an L-shaped camming surface, a portion of which extends beyond the vertical wall front surface plane, the first edge wall and the first side wall being substantially contiguous and defining an arcuate groove there between.

* * * * *